United States Patent [19]

DeVane

[11] Patent Number: 4,751,980

[45] Date of Patent: Jun. 21, 1988

[54] SOUND ATTENUATION APPARATUS

[76] Inventor: Harry M. DeVane, 1559 Pine St., Oxnard, Calif. 93030

[21] Appl. No.: 920,374

[22] Filed: Oct. 20, 1986

[51] Int. Cl.[4] ..... F01N 1/04; F01N 1/08

[52] U.S. Cl. ..... 181/239; 181/224; 181/257; 181/258; 181/264; 181/267; 181/272; 181/276; 181/280; 181/282

[58] Field of Search ..... 181/239, 240, 224, 267, 181/250, 251, 276, 279, 280, 404, 243, 258, 257, 264, 272, 282

[56] References Cited

U.S. PATENT DOCUMENTS

| | | | |
|---|---|---|---|
| 2,954,839 | 10/1960 | Gibel | 181/239 |
| 4,093,110 | 6/1978 | Johnson | 181/243 |
| 4,319,660 | 3/1982 | Bishop | 181/258 |
| 4,331,213 | 5/1982 | Taniguchi | 181/224 X |

FOREIGN PATENT DOCUMENTS

| | | | |
|---|---|---|---|
| 344439 | 11/1921 | Fed. Rep. of Germany | 181/239 |

*Primary Examiner*—Benjamin R. Fuller
*Attorney, Agent, or Firm*—Jack C. Munro

[57] ABSTRACT

A sound attenuation apparatus which is to be connected to an airflow duct and is to receive the air from the duct. The sound attenuation apparatus includes a mass of plates located in a stacked arrangement with peripheral gaps being formed between the plates. The airstream is to be conducted through an opening formed between the plates. The airstream is to be conducted into an opening formed within the center of the plates and then discharged into the ambient through the peripheral gap area. Each of the plates include a mass of holes.

8 Claims, 6 Drawing Sheets

SOUND ATTENUATION APPARATUS

BACKGROUND OF THE INVENTION

The field of this invention relates to a sound attenuation apparatus to diminish the level of sound emitted from a specific source, and more particularly to a sound attenuation apparatus for an airstream duct to diminish the sound that is produced by the device that is producing the air movement through the duct.

The moving of a gas through a duct system is exceedingly common within industry. A typical gas would be air. A common form of a device to move air through the duct system would be a blower. The basic construction of the blower would comprise a shaft upon which are mounted fan blades. Rotation of the blades results in air movement downstream of the blades. This air movement is directed by the duct system to a particular location.

Because of the physical size of the blower, it is common that a substantial amount of noise will be generated in its operation. To any individual working in close proximity to the blower, the noise generated not only can be annoying, but actually can be damaging to one's ears after a period of time.

It has been found that, like the air itself, the noise is directed downstream of the duct. It has been known in the past to connect some type of sound absorption apparatus in conjunction with the airstream to attenuate the sound produced by the blower while yet permitting the flow of the air through the duct to occur in a substantially unrestricted manner. There is a need to improve upon the efficiency of this attenuation so that the greater percentage of the sound is absorbed at a minimum manufacturing cost for the attenuation apparatus.

SUMMARY OF THE INVENTION

The sound attenuation apparatus of the present invention utilizes a mass of thin plates which are arranged in a stacked configuration with the majority of the plates located in a spaced relationship with each other. The peripheral surface of these plates is open to the ambient. Formed within the center of each plate is an opening with these center openings connecting with the airstream. The downstream surface of the plates is closed by a cover which includes a sound absorbing structure. Within each plate is formed a mass of holes which facilitate the absorption of sound as air is conducted between the plates and is discharged into the ambient. The peripheral surface of the plates may be tapered so as to decrease the amount of back pressure that is created.

DETAILED DESCRIPTION OF THE SHOWN EMBODIMENT

Figure 1:
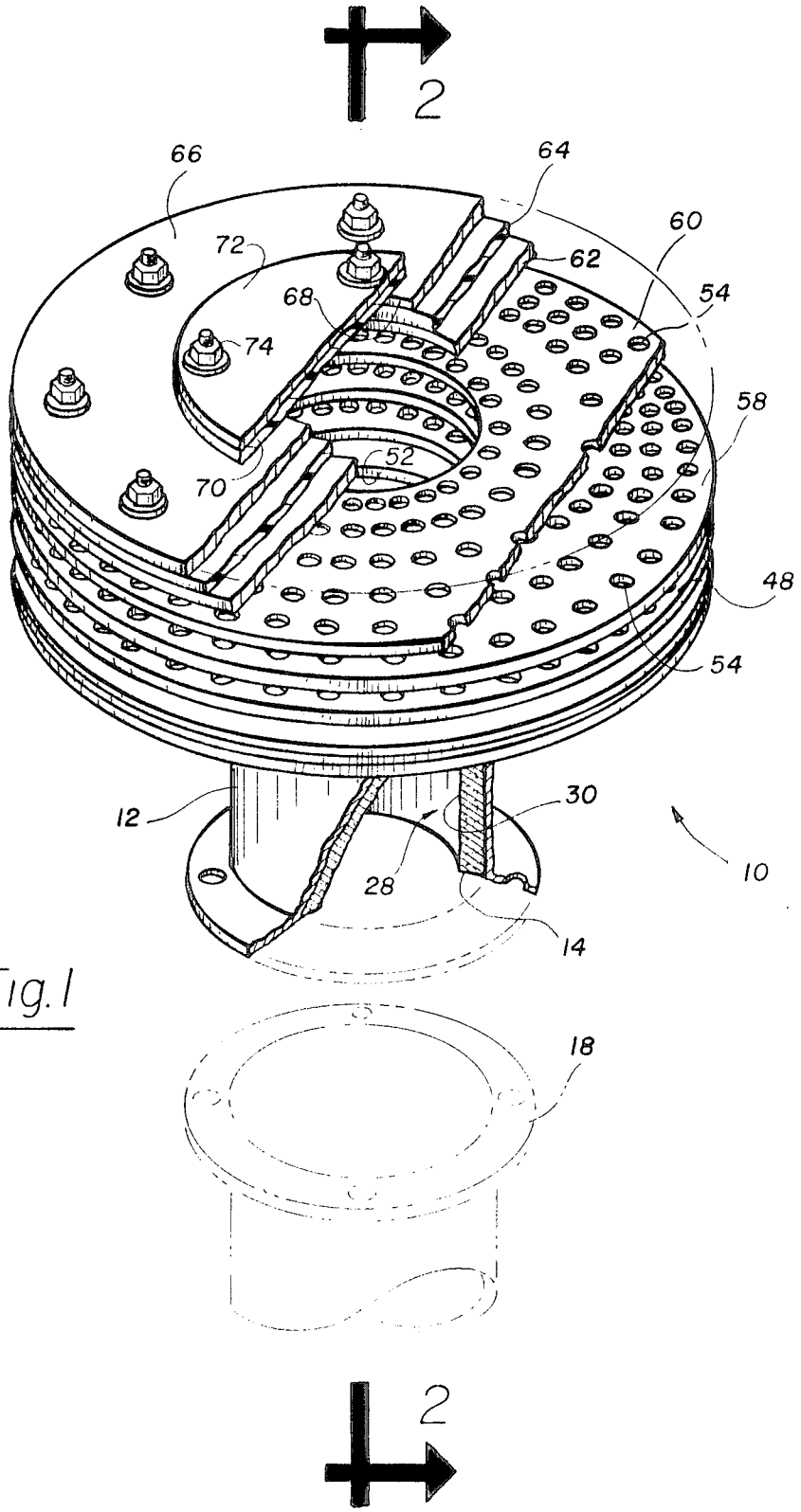
FIG. 1 is an isometric view, partly in cross-section and partly cut away, showing the sound attenuation apparatus of the present invention depicting its installation in conjunction with a typical airstream duct.
Figure 2:
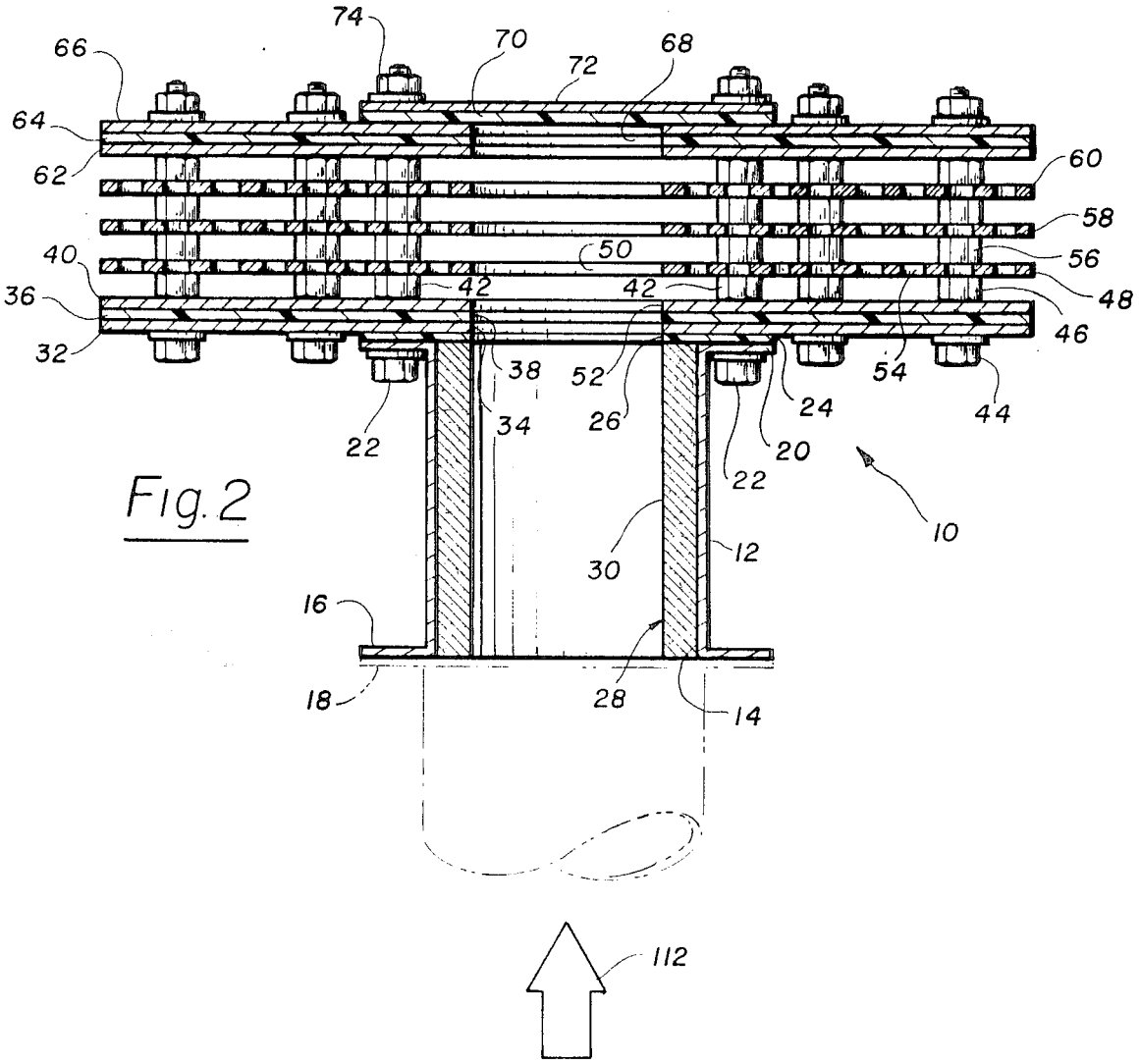
FIG. 2 is a cross-sectional view taken along line 2—2 of FIG. 1.

Referring particularly to FIGS. 1 and 2 of the drawings, there is shown the basic configuration 10 of the sound attenuation apparatus of this invention. This basic configuration includes an airflow duct 12 which is cylindrical in configuration and includes an internal chamber 14. The outer free edge of the airflow duct 12 is formed into a flange 16. The flange 16 is to be connectable by using a plurality of conventional bolt fasteners to an outlet duct 18 of a piece of equipment such as a blower (not shown).

The inner edge of the airflow duct 12 is formed into a flange 20. Flange 20 includes four in number of fastener holes, each of which is to connect with an elongated bolt 22. Mounted against the inside surface of the flange 20 is a vibration absorbing washer 24. The material of construction of the washer 24 would normally be of rubber. Washer 24 includes a center opening 26.

Inserted within the internal chamber 14 is an elongated sleeve 28. The length of the sleeve 28 is essentially identical to the length of the duct 12. The function of the sleeve 28 is to absorb vibration as air is conducted through the interior chamber 30 of the sleeve 28. Central opening 26 is aligned with the interior chamber 30. It is readily apparent from FIG. 2 that the interior chamber 30 is open-ended. The material of construction for the sleeve 28 will normally be of a sound absorbing and vibration absorbing material such as fiberglass.

Mounted on the washer 24 is a bottom plate 32. The bottom plate 32 will normally be constructed of metallic material such as aluminum. The bottom plate 32 also includes a center opening 34 which is aligned and of the same size of the center opening 26. The size of the plate 32 is substantially greater than the washer 24. It is to be noted that the peripheral edge of the plate 32 is circular.

Mounted on the plate 32 is an enlarged washer 36 which is essentially the same size as the plate 32. The washer 36 will normally be constructed of a rubber material or other similar sound absorbing and shock absorbing material. The enlarged washer 36 also includes a center opening 38. The size of the center opening 38 is identical to the center opening 34 and is in alignment therewith.

Mounted against the enlarged washer 36 is an inner lower plate 40. The plate 40 is basically identical to the plate 32. Plates 40 and 32 are tightly held together against the washer 36 by means of nuts 42 which are threadably engaged with the bolts 22.

Also, strategically located in a spaced apart arrangement through holes which are formed within the plates 32 and 40 are bolt fasteners 44. Connecting with the bolt fasteners 44 are nuts 46. These nuts 46 also function to tightly hold together the plates 32 and 40.

Connecting with the fasteners 22 and 44, and resting against the nuts 42 and 46, is a perforated plate 48. The perforated plate 48 also includes a center opening 50. This center opening 50 is in alignment with the center opening 52 of the plate 40 and is of the same size. Plate 48 will normally be constructed of a metallic material such as aluminum. The periphery of the plate 48 is of the same size as the plates 32 and 40. The difference between the plate 48 and the plate 40 is that the plate 48 includes a mass of spaced apart holes 54. Holding the plate 48 onto the nuts 42 and 46 are nuts 56 which engage with the fasteners 22 and 44.

A plate 58 is similarly mounted onto the plate 48 as is also a plate 60 mounted onto the plate 58. Both plates 58 and 60 include holes 54. It is to be understood that the securing of the plates 58 and 60 in their established stacked relationship will also be by utilizing of nuts 56 which engage with fasteners 22 and 44.

Mounted on the nuts 56, which are last in the series, is an inner upper plate 62. The plate 62 is basically identical to plate 40. Mounted against the plate 62 is an enlarged washer 64 which is basically identical to the washer 36. Mounted against the washer 64 is a plate 66 which is again identical to the plate 32. It is to be understood that the plates 66 and 62, as well as washer 64 and plates 60 and 58, each include center openings which align with and are the same size as the center opening 50.

The fasteners 22 and 44 protrude exteriorly from the plate 66. Mounted against the exterior surface of the plate 66 and covering the center opening 68 of the plate 66 is a solid rubber washer 70. Mounted tightly against the washer 70 is a cover plate 72. The size of the cover plate 72 is substantially less than the size of the plate 66. The cover plate 62 includes holes through which are conducted bolt fasteners 22. Nuts 74 connect with the bolts 22 and are tightened against the plate 72.

Air is to be conducted from the duct 18 into the interior chamber 30 of the sleeve 28. The airstream is then conducted into the central opening which is constructed by center openings 26, 34, 38, 52 and 50 as well as the similar center openings of plates 58, 60, 62, 66 and washer 64. The outlet path for this airstream into the ambient is between the plates 40 and 48, between plates 48 and 58, between plates 58 and 60, and also between plates 60 and 62. As the airstream is moved across the plates 48, 58 and 60, the sound waves that are being conducted along with the airstream are bouncing not only against the plates 48, 58 and 60 but also against the holes 54. These holes 54 function to reflect these sound waves back against themselves which causes in essence a cancelling effect. As a result, the sound that is emitted into the ambient from the periphery of the plates 40, 48, 58, 60 and 62 is substantially diminished from what would normally be emitted if holes 54 were not located within the plates.

Figure 3:
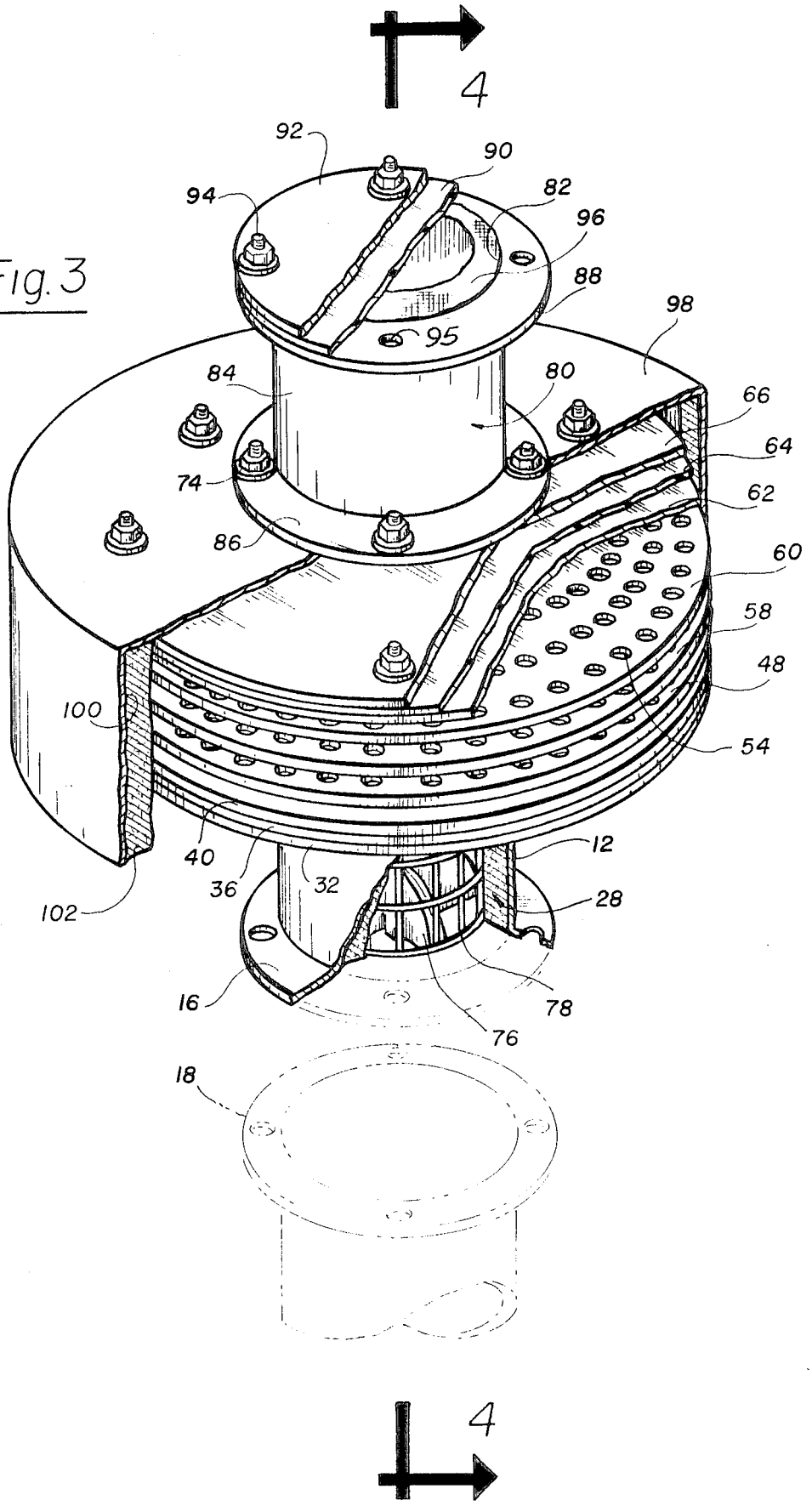
FIG. 3 is a view, similar to FIG. 1, of a first modified form of the sound attenuation apparatus.
Figure 4:
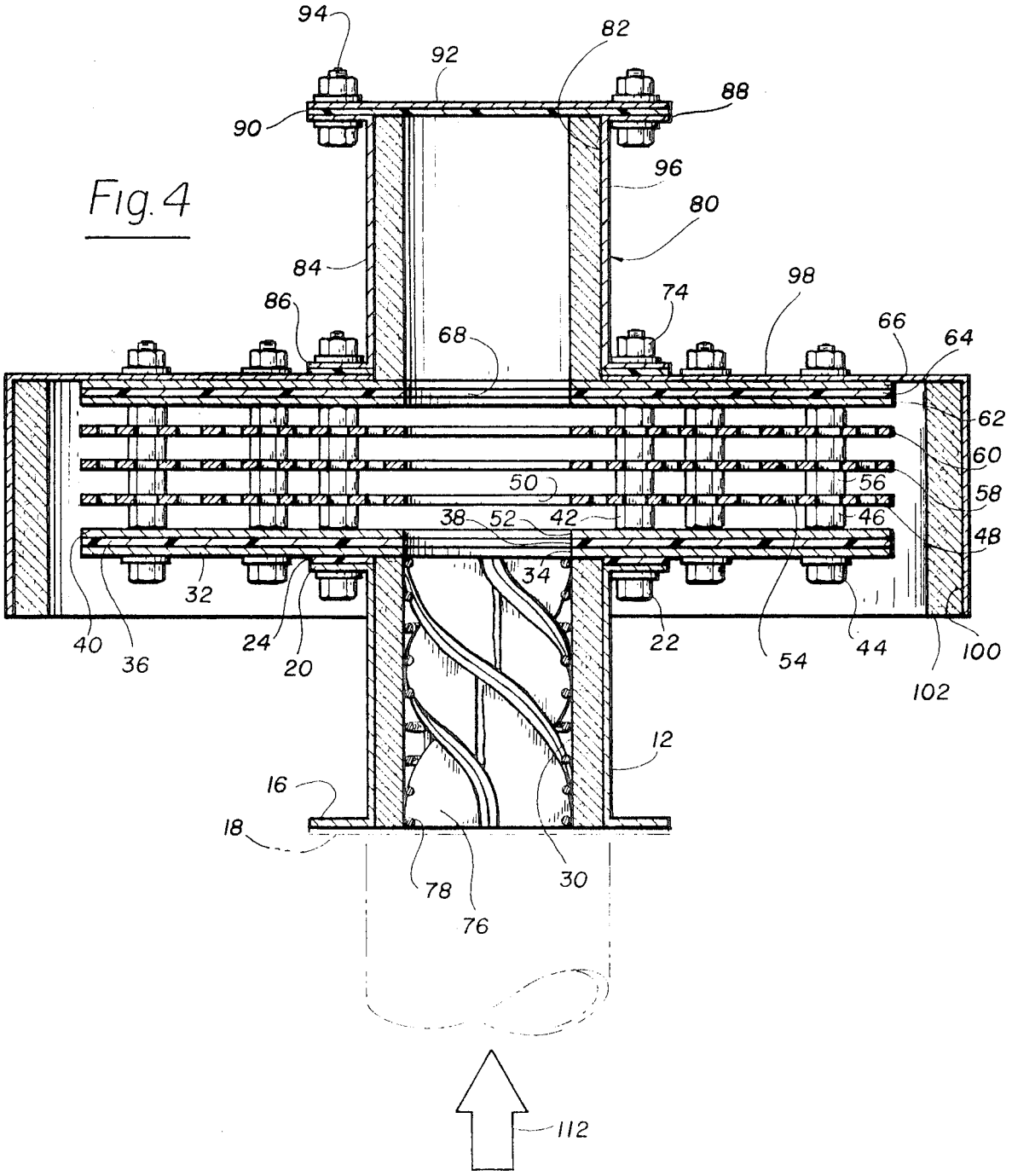
FIG. 4 is a cross-sectional view taken along line 4—4 of FIG. 3.

Referring particularly to FIGS. 3 and 4 of the drawings, like numerals have been utilized to refer to like parts in comparing FIGS. 3 and 4 with FIGS. 1 and 2. The difference in structure of FIGS. 3 and 4, over that of FIGS. 1 and 2, is directed to the including of a plurality of helically twisted vanes 76 within the sleeve 28. These vanes 76 are held in position by means of a wire screen 78 located between the vanes 76 and the sleeve 28. Basically, the construction of each of the vanes 76 will be of a fiberglass or other similar type of sound absorbing material. There will normally be utilized four in number of the vanes 76. The vanes 76 and the screening 78, as well as their sleeve 28, can take the form of a single unit which can be inserted within the internal chamber 14 of the duct 12. For a more complete description of this insert, reference is to be had to U.S. patent application Ser. No. 914,274, filed Oct. 2, 1986, by the same inventor, entitled "SOUND ATTENUATOR".

Another difference of structure of FIGS. 3 and 4 versus that of FIGS. 1 and 2 is instead of utilizing the cover plate 72, there is utilized a resonator 80. This resonator 80 is basically constructed of housing 84 which has elongated internal chamber 82. One edge of the housing 84 terminates in a flange 86 which is secured to the bolts 22. The outer end of the housing 84 also terminates in a flange 88 upon which is mounted sound absorbing washer 90 and cover plate 92. The cover plate 92 and sound absorbing washer 90 are fixedly held in place on the flange 88 by means of bolt fasteners 94 which are conducted through holes 95 formed within the flange 88. Washer 90 and the cover plate 92 are identical to washer 70 and cover plate 72.

Located within the internal chamber 82 is a sound absorbing sleeve 96 which is against basically identical to sleeve 28. It is also considered to be within the scope of FIGS. 3 and 4 to utilize the vane insert arrangement shown located within the internal chamber 14 of the airflow duct 12 instead of just the sleeve 96. The function of the resonator 80 is to substantially diminish the sound which may be imparted to the ambient through the cover plate 72 of FIGS. 1 and 2. Within certain environments or when dealing with certain frequencies, the use of the resonator 80 may be necessary.

To further attenuate the sound within FIGS. 3 and 4, there may be mounted a closing cover 98 about the stacked series of plates. This cover 98 will not only function to further absorb sound, but also can function as a weather protector. Cover 98 is basically formed of sheet metal and is fixedly mounted by means of the bolt fasteners 22 and 44 onto the exterior surface of the plate 66. Cover 98 includes an interior chamber 100 which is open at its lower end. Mounted to the inner wall of the cover 98 and located within the interior chamber 100 is an enlarged sound absorbing sleeve 102. The material of construction of the sleeve 102 is basically identical to the material of construction of the sleeve 28.

Figure 5:
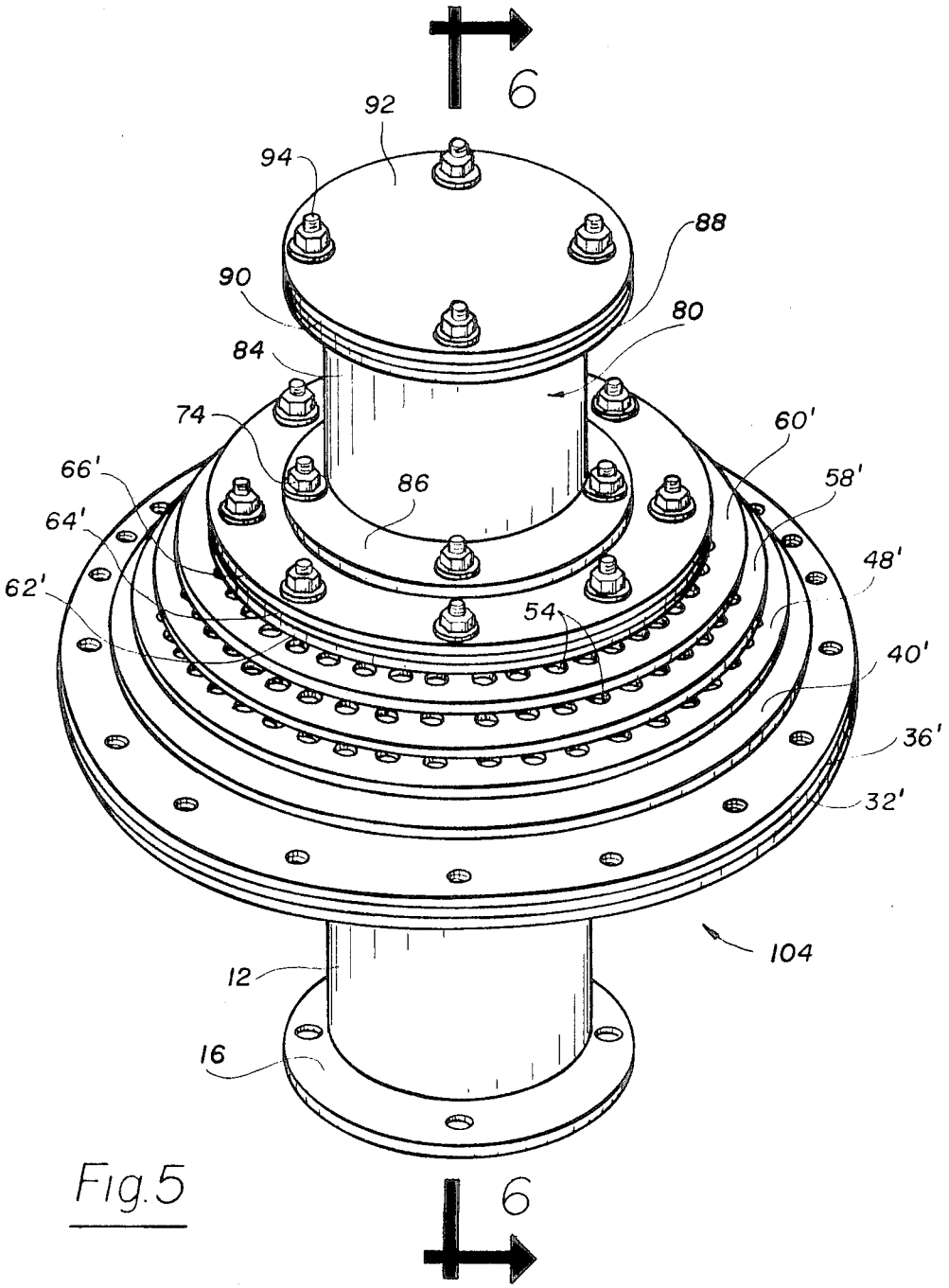
FIG. 5 is an isometric view of a second modification of the sound attenuation apparatus of the present invention.
Figure 6:
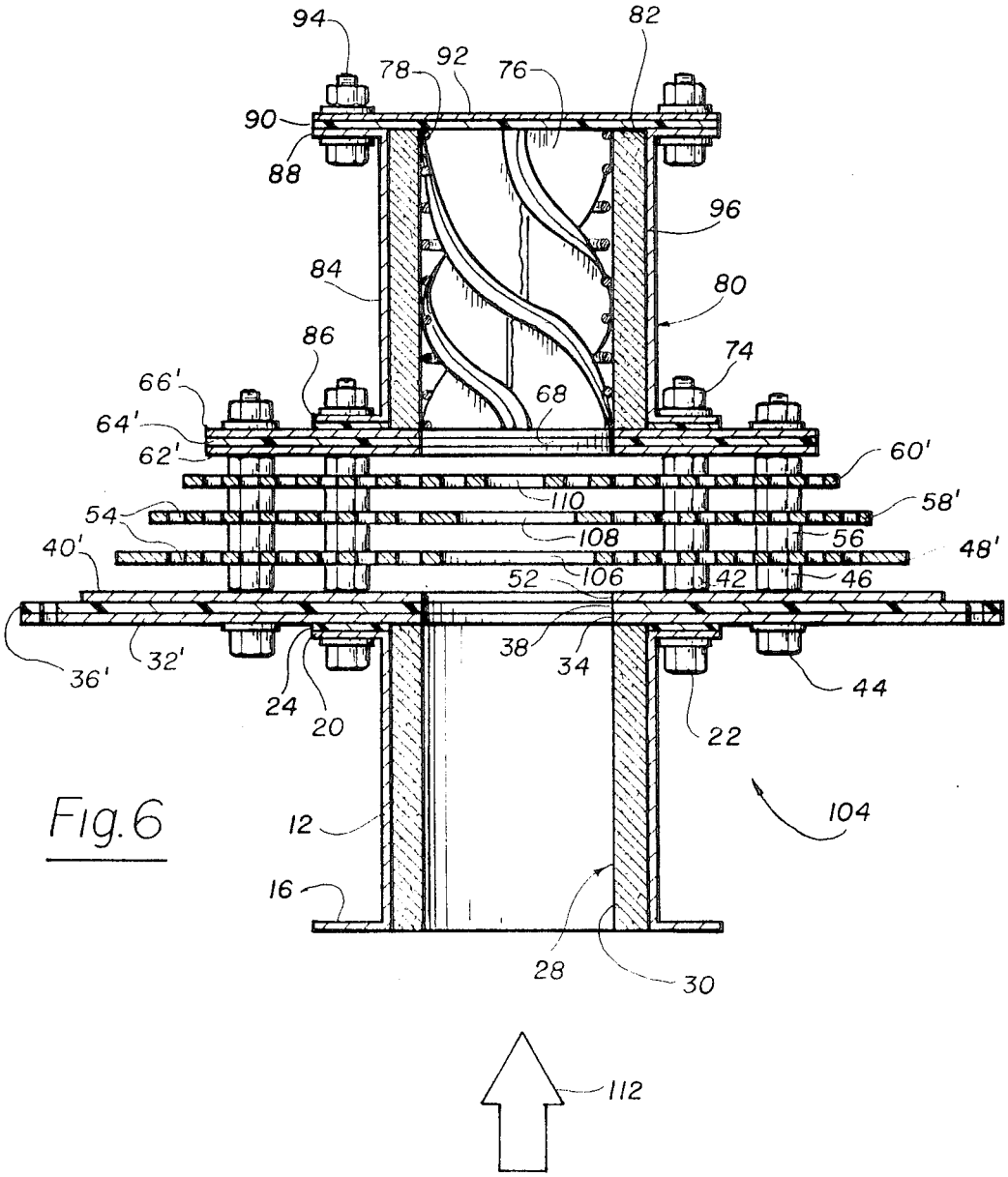
FIG. 6 is a cross-sectional view taken along line 6—6 of FIG. 5.

Referring particularly to FIGS. 5 and 6 of the drawings, there is shown a modified version 104 of the sound attenuating apparatus of this invention. Again, like numerals have been utilized to refer to like parts. The only difference between FIGS. 5 and 6 than that of FIGS. 1 through 4 has to do with the modification of plates 48, 58 and 60 which are shown in FIGS. 5 and 6 as plates 48', 58' and 60'. It is to be noticed that plate 48' is slightly less in size than plate 40, and also it is noted that the peripheral size of the plate 58' is somewhat less than 48'. Additionally, the peripheral size of plate 60' is still smaller than plate 58'. It is also to be noticed that the plates 62' and 66', which are equivalent to plate 62 and 66 of FIGS. 1 through 4, and washer 64', which is equivalent to washer 64, are somewhat smaller in peripheral size than the plate 60'. This gradual diminishing in size of the plates assumes a tapering configuration. It is still to be noticed that the each of the plates 48', 58' and 60' include a series of holes 54'.

The central opening 106 of the plate 48' is shown to be somewhat smaller in diameter the interior chamber 30 of the sleeve 28. Still further, it is to be noticed that the center opening 108 of plate 58' is somewhat smaller than the center opening 106. And still further, the center opening 110 of the plate 60' is somewhat smaller than the center opening 108.

The embodiment 104 is designed primarily to decrease the amount of back pressure against the movement of the air represented by arrow 112 within FIG. 6. The diminishing of back pressure may be a necessary requirement when dealing with certain types of air moving equipment. The reason this back pressure is diminished is because the openings 106, 108 and 112 are restrictive with respect to the overall size of the airflow stream. This restrictiveness encourages redirecting of the flow of the air toward the periphery of the plates 48', 58' and 60'. Because of this restrictiveness, the air is encouraged to flow toward the peripheries of the plates 48', 50' and 60' rather than being directed into resonator 80'. In essence, use of the steadily decreasing sizes of the opening 106, 108 and 110 encourage the annular discharge of the air from the series of stacked plated thereby decreasing the build-up of an air pressure barrier within the resonator 80.

Also, because the peripheral edges of plates 48', 58' and 60' are tapered, the air is emitted at different peripheral locations as opposed to the same peripheral locations within FIGS. 1 through 4. It is believed that this different peripheral location arrangement for the emitting of the air decreases the creation of the wall of sound which may be created within FIG. 1 through 4 because the air leaves the plates at the same cylindrical location. Therefore, the overall effect of tapering of the center openings 106, 108 and 110, and the tapering of the peripheral edges of the plates 48', 58' and 60', produces a higher performance sound attenuator within certain frequency ranges in conjunction with certain types of equipment.

It has been discovered that the sound attenuation apparatus shown within FIGS. 1 through 6 generally achieves a thirty to forty percent reduction in noise. Within some frequencies, the reduction is greater and within other frequencies the reduction is less. But overall this amount of reduction of noise is deemed to be substantial and can decrease noise level of a blower from an intolerable level, by a human being, to a tolerable level.

Although it has been found that holes 54 and 54' are preferred, other types of hiatuses could be used. For example, a series of bumps instead of holes or a series of concentric ribs.

What is claimed is:

1. A sound attenuation apparatus comprising:

an airflow duct having an air inlet and an air outlet, said air inlet adapted to connect with an airstream emitting source;

a plurality of plates mounted in a stacked relationship, said plates having a centrally located opening connected to said air outlet and adapted to receive the airstream produced by the airstream emitting source, said plates being mounted in juxtaposition and spaced apart forming a peripheral gap area through which the airstream is to be discharged into the ambient, each said plate including hiatus means, said hiatus means comprising reflecting means for reflecting sound waves that are being conducted along with the airstream with this reflection causing a canceling effect hence a diminishing of the amount of sound being emitted into the ambient, said hiatus means located all the way across each said plate; and cover means attached to said plates, said cover means covering said centrally located opening, said cover means including sound absorption means.

2. A sound attenuation apparatus comprising:

an airflow duct having an air inlet and an air outlet, said air inlet adapted to connect with an airstream emitting source;

a plurality of plates mounted in a stacked relationship, said plates having a centrally located opening connected to said air outlet and adapted to receive the airstream produced by the airstream emitting source, said plates being mounted in juxaposition and spaced apart forming a peripheral gap area through which the airstream is to be discharged into the ambient, each said plate including hiatus means, said hiatus means for reflecting sound waves that are being conducted along with the airstream with this reflection causing a canceling effect hence a diminishing of the amount of sound being emitted into the ambient, said hiatus means located all the way across each said plate;

cover means attached to said plates, said cover means covering said centrally located opening, said cover means including sound absorption means; and said hiatus means comprising a plurality of holes formed within each said plate.

3. The sound attenuation apparatus as defined in claim 2 wherein:

said peripheral gap area being annular.

4. The sound attenuation apparatus as defined in claim 3 wherein:

said plates being constructed of metallic material.

5. A sound attenuation apparatus comprising:

an airflow duct having an air inlet and an air outlet, said air inlet adapted to connect with an airstream emitting source;

a plurality of plates mounted in a stacked relationship, said plates having a centrally located opening connected to said air outlet and adapted to receive the airstream produced by the airstream emitting source, said plates being mounted in juxtaposition and spaced apart forming a peripheral gap area through which the airstream is to be discharged into the ambient, each said plate including hiatus means;

cover means attached to said plates, said cover means covering said centrally located opening, said cover means including sound absorption means;

said hiatus means comprising a plurality of holes formed within each said plate;

said peripheral gap area being annular; and said peripheral gap area forming a tapered configuration.

6. A sound attenuation apparatus comprising:

an airflow duct having an air inlet and an air outlet, said air inlet adapted to connect with an airstream emitting source;

a plurality of plates mounted in a stacked relationship, said plates having a centrally located opening connected to said air outlet and adapted to receive the airstream produced by the airstream emitting source, said plates being mounted in juxtaposition and spaced apart forming a peripheral gap area through which the airstream is to be discharged into the ambient, each said plate including hiatus means, said hiatus means comprising reflecting means for reflecting sound waves that are being conducted along with the airstream with this reflection causing a canceling effect hence a diminishing of the amount of sound being emitted into the ambient, said hiatus means located all the way across each said plate;

cover means attached to said plates, said cover means covering said centrally located opening, said cover means including sound absorption means; and said cover means defining a resonator, said resonator having an elongated tubular member, said elongated tubular member having an internal chamber defining said resonator, a sound absorbing mechanism located within said internal chamber.

7. The sound attenuation apparatus as defined in claim 5 wherein:

said centrally located opening defining a tapered wall configuration.

8. The sound attenuation apparatus as defined in claim 6 wherein:

said sound absorbing mechanism comprising a plurality of helical vanes mounted within a sound absorbing sleeve.

* * * * *